US006158262A

United States Patent [19]

Goto et al.

[11] Patent Number: 6,158,262

[45] Date of Patent: Dec. 12, 2000

[54] PIERCING MILL AND CANNON EXCHANGE METHOD

[75] Inventors: Hisao Goto; Masaomi Nakamura, both of Wakayama, Japan

[73] Assignee: Sumitomo Metal Industries, Ltd., Osaka, Japan

[21] Appl. No.: 09/546,185

[22] Filed: Apr. 10, 2000

Related U.S. Application Data

[63] Continuation of application No. PCT/JP98/04572, Oct. 9, 1998.

[30] Foreign Application Priority Data

Oct. 13, 1997 [JP] Japan ..... 9-278904

[51] Int. Cl.[7] ..... B21B 17/10; B21B 39/20

[52] U.S. Cl. ..... 72/209; 72/250

[58] Field of Search ..... 72/209, 208, 96, 72/97, 250

[56] References Cited

U.S. PATENT DOCUMENTS

| | | | |
|---|---|---|---|
| 3,879,972 | 4/1975 | Kanai et al. | 72/97 |
| 3,927,547 | 12/1975 | Schonfeld et al. | 72/97 |
| 4,592,222 | 6/1986 | Muller et al. | 72/97 |
| 4,760,724 | 8/1988 | Okazaki et al. | 72/97 |

FOREIGN PATENT DOCUMENTS

| | | |
|---|---|---|
| 57-109505 | 7/1982 | Japan . |
| 60-43208 | 3/1985 | Japan . |

*Primary Examiner*—Rodney A. Butler
*Attorney, Agent, or Firm*—Armstrong, Westerman, Hattori, McLeland & Naughton

[57] ABSTRACT

A piercing mill and cannon exchange method therefor which can automate exchange of a cannon and can cope with flexible production of a variety of differently-sized seamless steel tubes in small quantities. The piercing mill including means for pivoting a cannon holder which holds a cannon and means for sliding the cannon holder along a pass line, through combined above-mentioned means, the cannon holder is pivoted so as to come into alignment with the pass line, is slid along the pass line, and is clamped at a predetermined location. The cannon exchange is characterized in that a cannon holder which retains the cannon in the direction perpendicular to the pass line is pivoted so as to come into alignment with the pass line, is slid along the pass line, and is then clamped to the main frame of the piercing mill. Therefore, it become possible to automate exchange of a cannon in accordance with a changeover and to considerably reduce working hours.

6 Claims, 6 Drawing Sheets

PIERCING MILL AND CANNON EXCHANGE METHOD

This application is a continuation of international application PCT/JP98/04572 filed on Oct. 9, 1998.

TECHNICAL FIELD OF THE INVENTION

The present invention relates to a piercing mill for manufacturing seamless steel tubes and to a cannon exchange method for use with the piercing mill. More particularly, the present invention relates to a piercing mill and a cannon exchange method for use therewith in which a cannon is automatically exchanged in accordance with a changeover so as to shorten the time required for exchange work, while enabling flexible manufacture of a variety of differently-sized seamless steel tubes in small quantities.

BACKGROUND ART OF THE INVENTION

As a method of manufacturing seamless steel tubes under hot working conditions, the Mannesmann tube-making process is widely employed. In this tube-making process, a round billet heated to a high temperature is fed as a material to be rolled into a piercing mill (a so-called "piercer"), which pierces the axial center portion of the round billet to obtain a hollow shell. The thus-obtained hollow shell is fed, directly or as needed after undergoing an expansion or wall-thinning process in an elongator having the same structure as that of the piercing mill, into a subsequent elongating mill such as a plug mill, a mandrel mill, or the like so as to be elongated. Subsequently, the thus-elongated tube undergoes a finishing process provided by a stretch reducer for shape correction, a reeler for polishing, and a sizer for sizing, thereby becoming a seamless steel tube product.

FIG. 1 is a schematic representation of the material to be rolled when it is pierced by the piercing mill. Piercing rollers 1, 1 are axisymmetrically arranged at a predetermined cross angle and feed angle with respect to a pass line X—X along which is rolled a round billet 3 serving as a material to be rolled. In the piercing mill having the piercing rollers 1, 1 arranged in the previously-described layout, the round billet 3 fed along the pass line X—X in the direction indicated by an outlined arrow is brought into gap with the piercing rollers 1, 1 and travels over the pass line while in rotation. A hole is pierced through the axial center of the of the billet 3 by a plug 2, thereby forming a hollow shell. During the piercing process, the plug 2 is supported by a mandrel supporting apparatus (not shown) so as to be positioned between the piercing rollers 1, 1 along the pass line.

As described above, the round billet 3 serving as the material to be rolled is intensively rotated when it is pierced. For this reason, if there is a bend in the round billet 3, or if the round billet 3 is bent as a result of having been unevenly cooled after a heating process, large deflections will develop in the round billet 3 when it undergoes the piercing and rolling processes. If large deflections develop in the round billet 3, the round billet 3 vigorously hits an entrance conveyor section of the piercing mill, and violent vibrations and loud noise arise. This may render the piercing and rolling operations unstable and generate flaws in the outer surface of the pierced hollow shell.

In general, in order to prevent such an accident, a cannon 4 serving as a cylindrical guide is disposed at the entrance of the piercing mill along the pass line X—X, as illustrated in FIG. 1. Even if deflections are caused by a bend in the round billet 3, the round billet 3 is rotated within the cannon 4, thereby ultimately protecting the outer surface of the hollow shell.

Since the cannon 4 disposed at the entrance of the piercing mill absorbs deflections in the round billet 3, it must be fixedly mounted on the main frame of the piercing mill. In contrast, in order to absorb the deflections in the round billet 3, it is necessary to maintain a constant clearance between the inner diameter of the cannon 4 and the round billet 3. For these reasons, it is necessary to exchange the cannon 4 every time the size of the round billet 3 serving as the material to be rolled is changed. Further, the round billet 3 is maintained at a high temperature when undergoing the piercing and rolling processes, and the inner surface of the cannon 4 is considerably damaged by the deflections in the round billet 3. Therefore, even if the size of the round billet 3 still remains unchanged, it is necessary to periodically exchange the cannon 4 in view of maintenance.

The cannon 4 of the conventional piercing mill is manually exchanged by use of a crane or a jib crane disposed at the entrance of the piercing mill. The manual exchange of the cannon 4 requires a large number of steps, thereby inevitably resulting in a reduction in the availability of the piercing mill. Particularly, in the case of recent continuous Mannesmann tube manufacturing facilities aimed at highly efficient production of seamless steel tubes, exchange of a cannon results in a reduction in the overall efficiency of manufacture of seamless steel tubes.

SUMMARY OF THE INVENTION

In light of the previously described problems associated with the exchange of a cannon in a conventional piercing mill, the object of the present invention is to provide a piercing mill and to a cannon exchange method for use therewith in which a cannon is automatically exchanged in accordance with a changeover so as to enable flexible manufacture of a variety of differently-sized seamless steel tubes in small quantities.

To this end, the gist of the present invention resides in a piercing mill for use in manufacturing seamless steel tubes and a method of exchanging a cannon used in a seamless tube piercing mill, which will be described in the following (1) to (3). Part numbers are shown in FIG. 2, which will be described later.

(1) A piercing mill of a seamless steel tube manufacturing system including a pair of piercing rollers disposed opposite to each other with respect to a pass line X—X along which a material to be rolled travels helically, a plug disposed along the pass line X—X so as to situate between the piercing rollers, a mill housing for holding the piercing rollers and the plug, and a cannon 4 for preventing deflections in the material provided at the entrance of the piercing rollers in the direction of the pass line X—X, the improvement being characterized by comprising: means 15 for pivoting a cannon holder 5 which retains the cannon 4; and means 16 for moving the cannon holder 5 in a sliding motion along the pass line X—X, whereby the cannon is exchanged automatically.

(2) A piercing mill of a seamless steel tube manufacturing system including a pair of piercing rollers disposed opposite to each other with respect to a pass line X—X along which a material to be rolled travels helically, a plug disposed along the pass line X—X so as to situate between the piercing rollers, a mill housing for holding the piercing rollers and the plug, and a cannon for preventing deflections in the material provided at the entrance of the piercing rollers in the direction of the pass line X—X, the improvement being characterized by the fact that the mill housing includes a cylinder 15 for pivoting a holder frame 10 which retains a cannon holder 5 for holding a cannon 4 in the direction perpendicular to the pass line X—X; the holder frame 10 includes a cylinder 16 for sliding the cannon holder 5 along the pass line X—X; and the mill housing further includes a cylinder 17 for fixing the cannon holder 5 to the main frame of the piercing mill, whereby, through combined actuation of the cylinders, the cannon holder 5 held in an elevated position in the direction perpendicular to the pass line X—X is pivoted so as to come in alignment with the pass line X—X, then travels over the pass line X—X in a slidable motion, and is clamped at a predetermined location.

In the piercing mills defined in (1) and (2), it is desirable to move the cannon holder from a cannon holder table to the entrance of the piercing mill by way of a cannon manipulator.

(3) A cannon exchange method for use in a seamless steel tube piercing mill in which a material to be rolled is inserted into a cannon 4 in order to prevent it from deflecting, and the material is helically moved along a pass line X—X by use of a pair of piercing rollers disposed opposite to each other with respect to the pass line X—X, so that a plug penetrates and pierces through the center of the material, the improvement being characterized by comprising the steps of: pivoting a cannon holder 5 which retains the cannon 4 in the direction perpendicular to the pass line X—X; sliding the cannon holder 5 along the pass line X—X; and clamping the cannon holder 5 to the main frame of the piercing mill.

In the cannon exchange method defined in (3), it is desirable that the cannon holder is transported from a cannon holder table to the entrance of the piercing mill, while being supported by a cannon manipulator, to thereby hold a cannon at a predetermined position and perpendicular to the pass line.

BEST MODE FOR CARRYING OUT THE INVENTION

Figure 1:
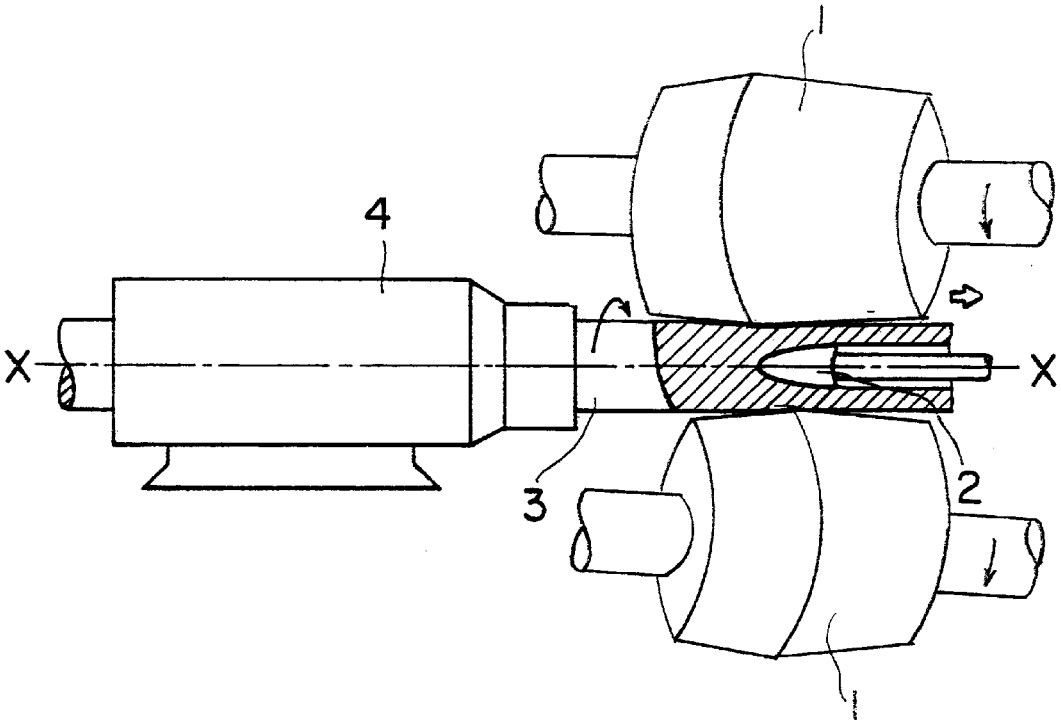
FIG. 1 is an illustration of a material to be rolled when it is pierced by the piercing mill.

A piercing mill of the present invention is chiefly characterized by comprising means for pivoting a cannon holder which holds a cannon and means for sliding the cannon holder along a pass line, and by automatic exchange of the cannon. More specifically, the piercing mill comprises a mill housing including a cylinder for pivoting a holder frame which retains a cannon holder for holding a cannon in the direction perpendicular to the pass line; the holder frame including a cylinder for sliding the cannon holder along the pass line; and the mill housing further including a cylinder for fixing the cannon holder to the main frame of the piercing mill, whereby, through combined actuation of the cylinders, the cannon holder held in an elevated position in the direction perpendicular to the pass line is pivoted so as to come in alignment with the pass line, then travels over the pass line in a slidable motion, and is clamped at a predetermined location.

A cannon exchange method of the present invention is used in the piercing mill having the foregoing structure and is characterized by comprising the steps of: pivoting a cannon holder which retains the cannon in the direction perpendicular to the pass line; sliding the cannon holder along the pass line; and clamping the cannon holder to the main frame of the piercing mill.

By virtue of the piercing mill and the cannon exchange method for use therewith of the present invention, it is possible to effectively utilize a space on the entrance side of the piercing mill by exchanging the cannon through combination of pivotal and slidable movements. This makes it possible to automate all the steps involved in exchange, from a step of removal of a current cannon to a step of clamping a new cannon to the piercing mill. Consequently, it is possible to achieve the previously-described reduction in the time required to exchange the cannon, as well as to significantly save labor in the operations themselves.

An example of a specific structure of the piercing mill of the present invention is shown in FIG. 2 through 6, with reference to which the effects of the present invention will be described in detail. Throughout the drawings, elements common to the drawings are assigned the same reference numerals.

Figure 2:
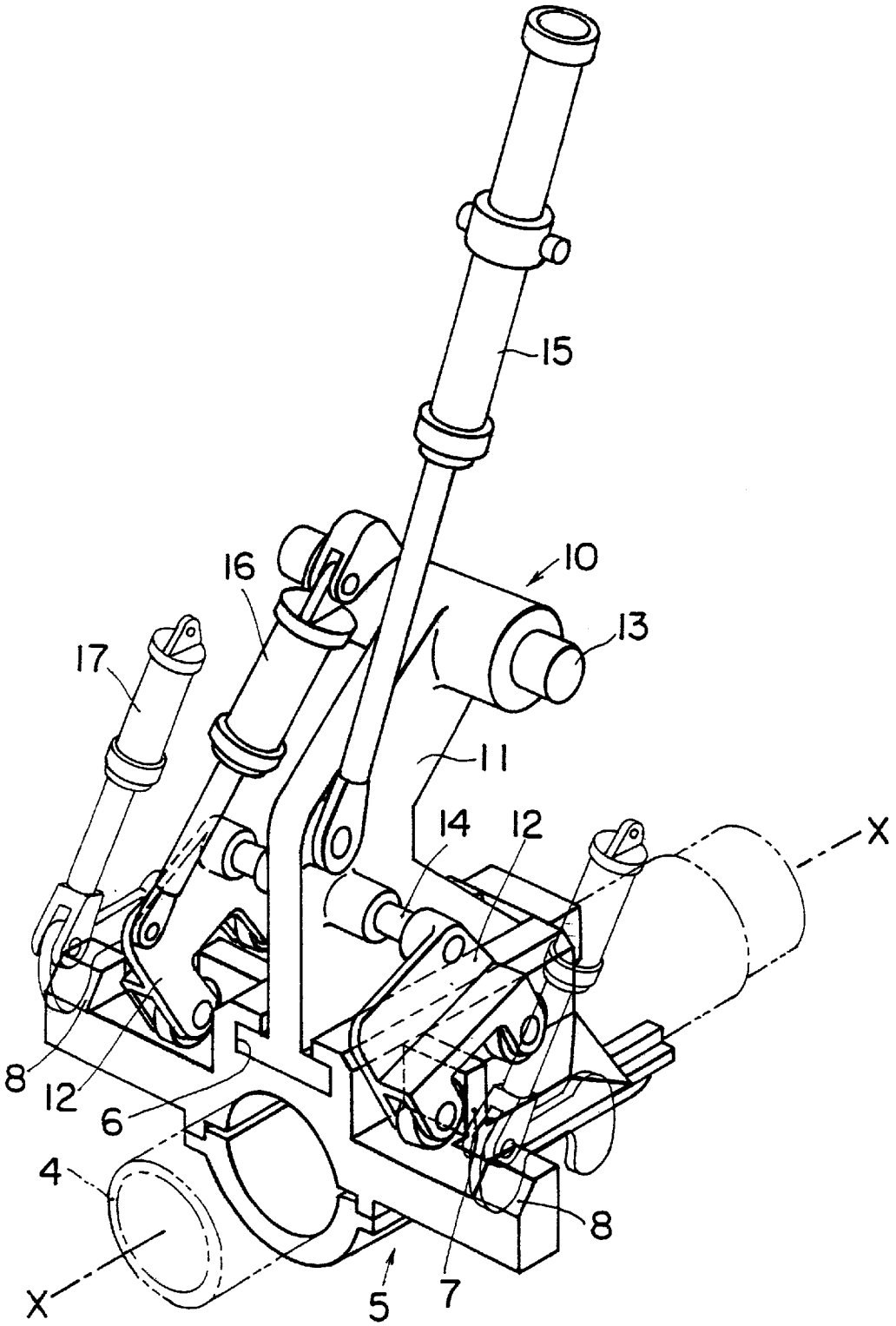
FIG. 2 is a perspective view illustrating the overall structure of a cannon and a cannon holder for holding the cannon of the present invention.
Figure 3:
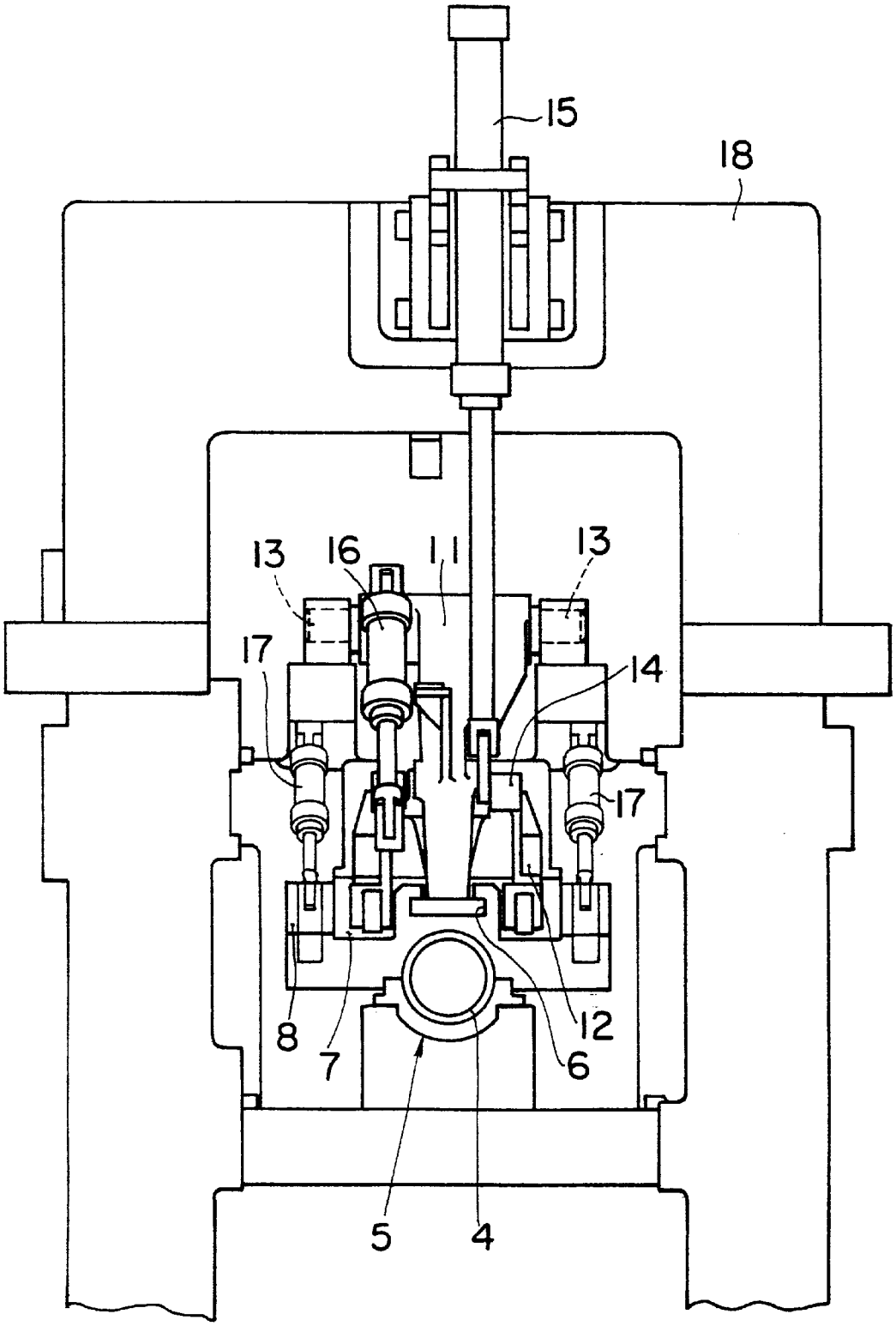
FIG. 3 is a front view illustrating the entrance-side of a piercing mill having the cannon and the cannon holder mounted thereon according to the present invention.

FIG. 2 is a perspective view illustrating the overall structure of a cannon and a cannon holder for holding the cannon of the present invention, and FIG. 3 is a front view illustrating the entrance-side of a piercing mill according to the present invention. As is obvious from FIG. 2 and 3, a dovetail groove 6 for receiving a holder frame 10 is formed in a cannon holder 5 which holds a cannon 4. The cannon holder 5 is supported by the holder frame 10 as a result of fitting of guide surfaces of the holder frame 10 into the dovetail groove 6, whereby the cannon holder 5 and the holder frame 10 are assembled into one.

The cannon holder 5 is further provided with slide blocks 7 and clamp blocks 8. The holder frame 10 is made up of a pivot frame 11, which will be described later, and slide frames 12. The pivot frame 11 pivots the cannon holder 5 about a pivot shaft 13 by virtue of the action of a pivot cylinder 15. Similarly, the slide frames 12 slide the cannon holder 5 about a slide shaft 14 by virtue of the action of a slide cylinder 16. As illustrated in FIG. 2, guide rolls are provided at opposite ends of the slide frame 12 in order to support the slide block 7 at the opposite ends.

As illustrated in FIG. 3, the pivot cylinder 15, which serves as a drive source for pivoting the cannon 4, is provided in an upper part of a mill housing 18 of the piercing mill. The end of the pivot cylinder 15 is attached to the pivot frame 11. Clamp cylinders 17 are provided to either side of the cannon holder 5 below the mill housing 18 for clamping the cannon holder 5 to the mill housing 18 in the final stage. The clamp cylinders 17 clamp the cannon holder 5 to the main frame of the piercing mill via the clamp blocks 8. The holder frame 10 is provided with the slide cylinder 16 for connecting the pivot frame 11 to the slide frames 12. The slide frames 12 formed into the double-end bracket are pivoted by actuation of the slide cylinder 16. As the slide frames 12 are pivoted, the slide blocks 7 are pushed, so that the cannon 4 travels along the pass line X—X in a slidable motion.

Next, specific operations required to exchange the cannon will be described in reference to steps (a) to (c).

(a) Movement of the Cannon Holder, and Fitting of the Holder Frame

Figure 4:
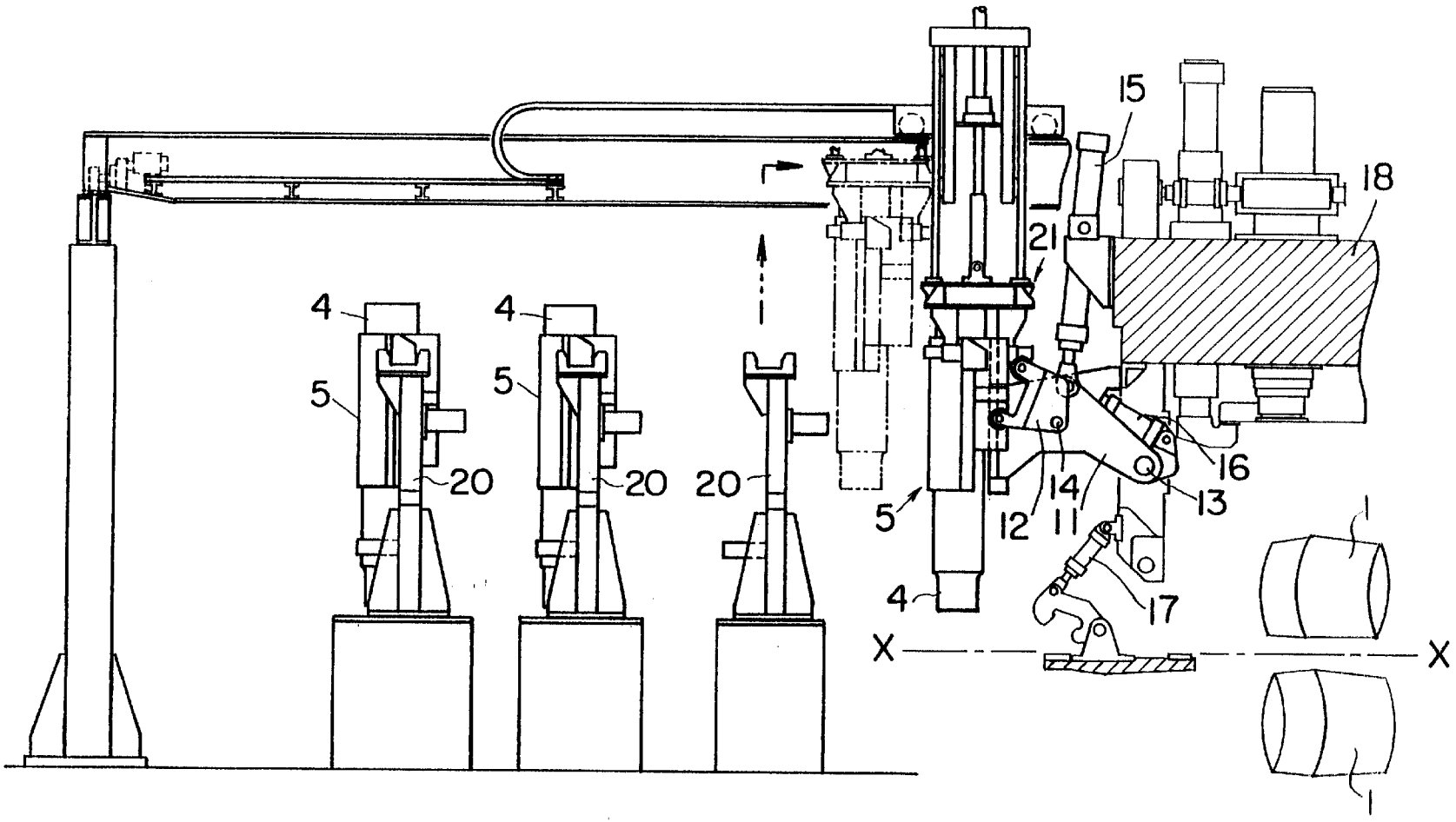
FIG. 4 is a side cross-sectional view showing a step of moving the cannon holder and attaching the holder frame to the piercing mill.

FIG. 4 is a side cross-sectional view of the piercing mill for explaining step (a). Several of the cannon holders 5 are stored on cannon holder tables 20 while retaining their respective cannons 4. The number of the cannon holder tables 20 is determined by the number of cannons 4. Associated with initiation of exchange of the cannon 4, the corresponding cannon holder 5 is grasped and lifted by the specifically-designed manipulator 21 from the cannon holder table 20 to a predetermined position on the entrance side of the piercing mill. The cannon holder 5 is gradually lowered so that the guide surfaces of the holder frame 11 fit into the dovetail groove 6. After the cannon holder 5 has been fitted to the holder frame 11, the specifically designed manipulator 21 is released from the cannon holder 5. At this time, as illustrated in FIG. 4, the cannon holder 5 is held in an elevated position in the direction perpendicular to the pass line X—X. Further, one end of the slide frames 12 comes into contact with the slide blocks 7 to thereby support the cannon holder 5.

(b) Pivotal Movement of the Cannon Holder

Figure 5:
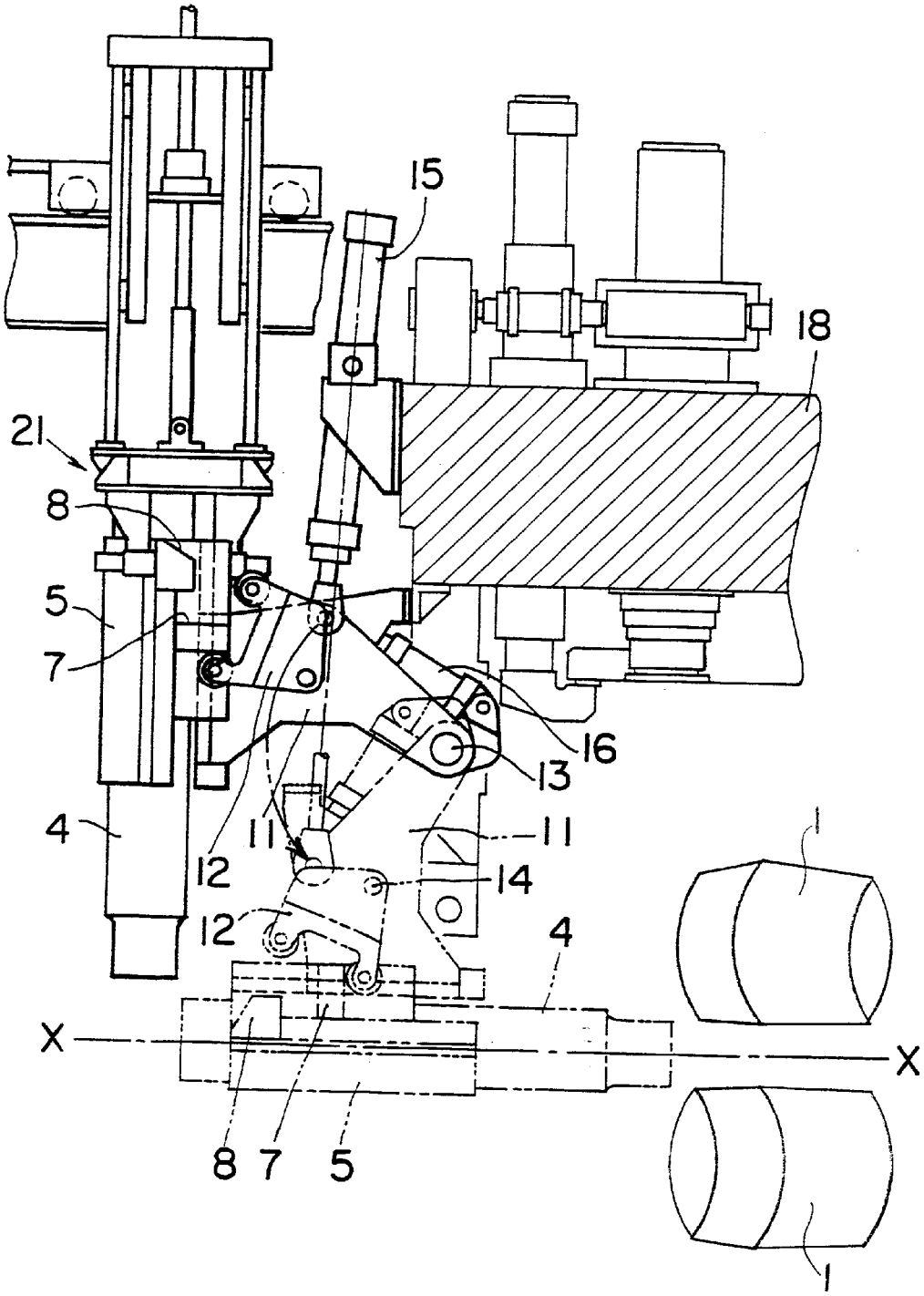
FIG. 5 is a side cross-sectional view showing a step of pivoting and moving the cannon holder.

FIG. 5 is a side cross-sectional view of the piercing mill for explaining step (b). The pivot frame 11 pivots through 90 degrees about the pivot shaft 13 by actuation of the pivot cylinder 15 mounted on the upper portion of the mill housing 18. In conjunction with this pivotal movement of the pivot frame 11, the cannon holder 5 is also pivoted so as to come to the entrance of the piercing rollers 1, 1 along the pass line X—X. As described above, even in the case of a relatively long cannon 4, it is possible to effectively utilize a narrow space in a three-dimensional way by moving the cannon 4 while utilizing pivotal movements.

(c) Slidable Movement and Clamping of the Cannon Holder

Figure 6:
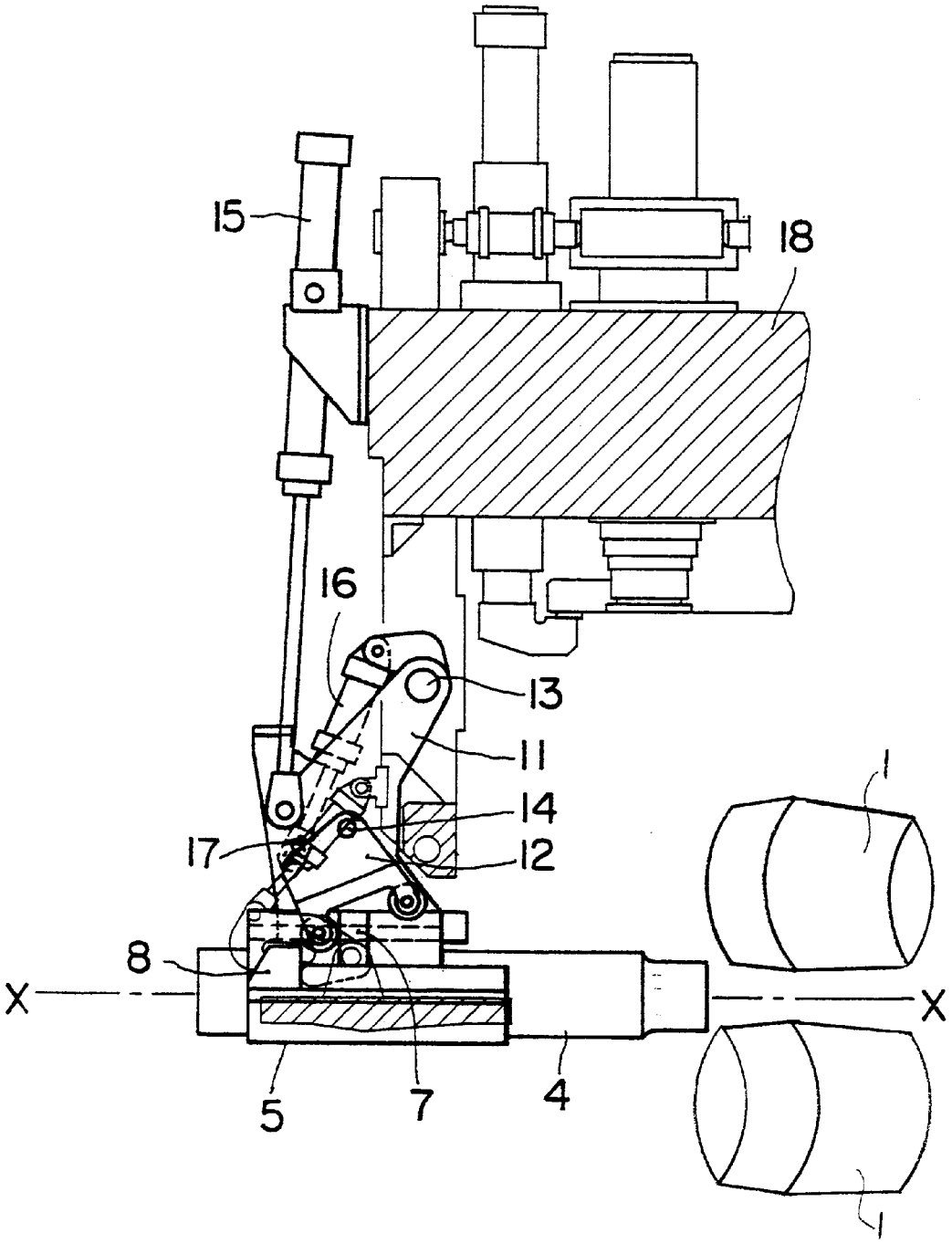
FIG. 6 is a side cross-sectional view showing a step of sliding the cannon holder and clamping it.

FIG. 6 is a side cross-sectional view of the piercing mill for explaining step (c). To bring the cannon 4 in sufficient proximity to the piercing rollers 1, 1, the cannon holder 5 is moved along the pass line X—X by actuating the slide cylinder 16. The slide frames 12 formed into the double-end bracket are pivoted by actuating the slide cylinder 16 that directly connects the pivot frame 11 to the slide frames 12. At this time, the other ends of the slide frames 12 opposite to the ends that have supported the slide blocks 7 now push the slide blocks 7, whereby the cannon 4 travels along the pass line X—X in a slidable motion. At this time, to ensure the slidable movement of the cannon holder 5, it is desirable to form a guide groove in a slide surface of the cannon holder 5 or to form a tapered guide in a slide portion of the cannon holder 5 in order to ensure centered alignment.

After the cannon holder 5 has finished traveling in a slidable motion, the clamp cylinder 17 attached to the mill housing 18 is actuated so as to clamp the cannon holder 5 to the main frame of the piercing mill via the clamp blocks 8. Subsequently, the material can become pierced and rolled.

For removal, the cannon currently clamped to the piercing mill can be exchanged by reversing the foregoing order of operations. As has been described, the entire series of operations for exchanging the cannon can be automated, which in turn makes it possible to considerably reduce working hours. For instance, in the seamless steel tube manufacturing facilities of the present invention, it has been confirmed that the operations from removal of a current cannon to the fitting of a new cannon to the piercing mill could be finished by 10% of the time conventionally required to perform them.

INDUSTRIAL APPLICABILITY

According to the piercing mill and the cannon exchange method of the present invention, it is possible to automate exchange of a cannon in accordance with a changeover and to considerably reduce exchanging hours. Further, it is possible to accomplish highly efficient production of a variety of differently sized seamless steel tubes in small quantities.

Therefore, the piercing mill and the cannon exchange method of the present invention can be widely utilized in the field of hot rolling of steel tubes.

What is claimed is:

1. A piercing mill of a seamless steel tube manufacturing system comprising:

a pair of piercing rollers disposed opposite to each other with respect to a pass line along which a material to be rolled travels helically;

a plug disposed along the pass line so as to situate between the piercing rollers;

a mill housing for housing the piercing rollers and the plug;

a cannon for preventing deflections in the material provided at the entrance of the piercing rollers in the direction of the pass line;

a first cylinder provided on the mill housing and adapted to pivot a holder frame which retains a cannon holder for holding a cannon in the direction perpendicular to the pass line;

a second cylinder provided on the holder frame and adapted to slide the cannon holder along the pass line; and a third cylinder provided on the mill housing and adapted to fix the cannon holder to the main frame of the piercing mill, whereby, through combined actuation of the cylinders, the cannon holder held in an elevated position in the direction perpendicular to the pass line is pivoted so as to come in alignment with the pass line, then travels over the pass line in a slidable motion, and is clamped at a predetermined location.

2. The piercing mill as defined in claim 1, wherein the cannon holder is moved from a cannon holder table to the entrance of the piercing mill by way of a cannon manipulator.

3. A piercing mill of a seamless steel tube manufacturing system comprising:

a pair of piercing rollers disposed opposite to each other with respect to a pass line along which a material to be rolled travels helically;

a plug disposed along the pass line so as to situate between the piercing rollers;

a mill housing for holding the piercing rollers and the plug;

a cannon for preventing deflections in the material provided at the entrance of the piercing rollers in the direction of the pass line;

means for pivoting a cannon holder which retains the cannon; and means for moving the cannon holder in a slidable motion along the pass line, whereby the cannon is exchanged automatically.

4. The piercing mill as defined in claim 3, wherein the cannon holder is moved from a cannon holder table to the entrance of the piercing mill by way of a cannon manipulator.

5. A cannon exchange method for use in a seamless steel tube piercing mill in which a material to be rolled is inserted into a cannon in order to prevent it from deflecting, and the material is helically moved along a pass line by use of a pair of piercing rollers disposed opposite to each other with respect to the pass line, so that a plug penetrates and pierces through the center of the material, the method comprising the steps of:

pivoting a cannon holder which retains the cannon in the direction perpendicular to the pass line;

sliding the cannon holder along the pass line; and clamping the cannon holder to the main frame of the piercing mill.

6. A cannon exchange method according to claim 5, further comprising the step of transporting the cannon holder from a cannon holder table to the entrance of the piercing mill, while being supported by a cannon manipulator, to thereby hold a cannon at a predetermined position and perpendicular to the pass line.

* * * * *